US006833660B2

(12) United States Patent
Kim

(10) Patent No.: US 6,833,660 B2
(45) Date of Patent: Dec. 21, 2004

(54) CATHODE RAY TUBE

(75) Inventor: Yong-Kun Kim, Kumi (KR)

(73) Assignee: LG. Philips Displays Korea Co., Ltd., Kyeongsangbuk-Do (KR)

( * ) Notice: Subject to any disclaimer, the term of this patent is extended or adjusted under 35 U.S.C. 154(b) by 0 days.

(21) Appl. No.: 10/374,042

(22) Filed: Feb. 27, 2003

(65) Prior Publication Data

US 2003/0227244 A1 Dec. 11, 2003

(30) Foreign Application Priority Data

Jun. 7, 2002 (KR) ..... 10-2002-0032083

(51) Int. Cl.[7] ..... H01J 29/07
(52) U.S. Cl. ..... 313/402; 313/407
(58) Field of Search ..... 313/402, 406–408

(56) References Cited

U.S. PATENT DOCUMENTS 3,772,555 A 11/1973 McKee et al.
4,437,036 A 3/1984 Ragland, Jr.
5,057,737 A 10/1991 Hotta
5,189,334 A * 2/1993 Park ..... 313/402
5,552,661 A 9/1996 Lee
6,111,346 A 8/2000 Ito et al.
6,323,589 B1 11/2001 Inoue et al.
6,630,776 B2 * 10/2003 Nakayama et al. ..... 313/407

FOREIGN PATENT DOCUMENTS

EP 0881658 A1 12/1998
JP 2000149811 5/2000
JP 2001057162 2/2001
JP 2002025458 1/2002

* cited by examiner

*Primary Examiner*—Ashok Patel
(74) *Attorney, Agent, or Firm*—Birch, Stewart, Kolasch & Birch, LLP

(57) ABSTRACT

A cathode ray tube including a shadow mask which is composed of a effective portion having a plurality of holes through which an electron beam passes and a skirt portion extended approximately in a perpendicular direction to the effective portion, wherein a guiding notch is formed in the skirt portion, the guiding notch includes an end portion which is formed to be opened to the end of the skirt portion and a fixing portion to which a guiding means is fixed, and a width of the end portion is wider than the diameter of the fixing portion. Therefore, the doming effect of the shadow mask is reduced and performance of press processing of the shadow mask can be improved.

18 Claims, 7 Drawing Sheets

CATHODE RAY TUBE

BACKGROUND OF THE INVENTION

1. Field of the Invention

The present invention relates to a cathode ray tube and particularly, to a cathode ray tube, capable of degrading doming effect of a shadow mask and improving performance in press molding of the shadow mask.

2. Description of the Background Art

Generally, a cathode ray tube is a device for converting an electric signal into an electric beam and optically implementing a screen by emitting the electron beam on a fluorescent surface. The device is excellent in displaying quality for a price and accordingly it is widely used.

The cathode ray tube will be described with reference to the accompanied drawings.

FIG. 1 is a schematic view showing an example of a cathode ray tube.

As shown in FIG. 1, the cathode ray tube includes a panel 3 which is a front glass, a funnel 2 which is a rear glass for forming a vacuous space while being combined with the panel 3, a fluorescent surface 13 for functioning as a luminescent material while being coated on an inner surface of the panel 3, an electron gun 6 through which an electron beam 5 for emitting the fluorescent surface 13, a deflection yoke 7 for deflecting the electron beam 5 to the fluorescent surface 13 being mounted in a separated position on an outer circumferential surface of the funnel 2 at a predetermined interval, a shadow mask 8 which is installed in a predetermined interval from the fluorescent surface 13, a mask frame 9 for fixing/supporting the shadow mask 8 and an inner shield 10 which is installed in an extended shape from the panel 3 to the funnel 2, for preventing color purity from being inferior by a magnetic effect by shielding an outer terrestrial magnetism.

Also, in an inner side of the panel 3, a spring supporter 14 in which a supporting spring for elastically supporting the mask frame 9 on the panel 3 is fixed is mounted, a reinforcing band 12 for dispersing a stress generated in the panel 3 and the funnel 2 is installed at an outer side circumference of the panel 3.

As shown in FIG. 2, the shadow mask 8 is a device for sorting colors so that an electron beam 5 emitted from the electron gun 6 can selectively blow a fluorescent surface which is coated on the panel 3, and it includes a effective portion 17 having a plurality of electron beam through holes 15 at the center, a ineffective portion 19 which is formed at the circumference of the effective portion 17 without having the electron beam through hole 15, and a skirt portion 21 which is formed at the circumference of the non-effective portion 19 and is fixed on the mask frame 9.

On one surface of the skirt portion 21 of the shadow mask 8, a guiding notch 18 in which a guiding pin (not shown) of a press device (not shown) for deciding the standard position of the shadow mask in press molding for forming a surface of the shadow mask 8 and the skirt portion 21 is formed.

Here, the guiding pin prevents deflection and rotation of the shadow mask 8 in press molding of the shadow mask 8 and the shape is different according to models of the shadow mask and manufacturers.

Therefore, the guiding notch 18 is formed to match the diameter of the respective guiding pins, and is selectively formed on several sides among four sides of the skirt portion 21 of the shadow mask 8.

On the other hand, the shadow mask 8 is positioned adjacent to the fluorescent surface 13 of the panel 3 as the skirt portion 21 is welded and fixed on the side surface of the mask frame 9 in a spot welding method and the like and the mask frame 9 is fixed on the panel 3.

The conventional cathode ray tube with the above structure implements a screen as the electron beam 5 is deflected by the deflection yoke 7, passes through a plurality of electron beam through holes 15 which are formed in the shadow mask 8 and landed on the fluorescent surface 13 formed on the inner surface of the panel 3, and each luminescent material of the fluorescent surface 13 emits light.

At this time, part of the electron beam 5 impinges on the shadow mask 8 without passing through the electron beam through hole 15, and high heat is generated in the shadow mask 8 by impingement of the electron beam 5.

Therefore, the shadow mask 8 gradually becomes deformed by heat, and this is called as a doming effect.

Since the doming effect changes the position of the electron beam through holes 15, miss-landing that the electron beam can not land on an appropriate fluorescent material, and a color bleed is displayed on the screen. Therefore, a color bleed is generated by a small amount of doming effect since the electron beam through hole is very fine.

The doming effect is generated by thermal expansion of the shadow mask 8 due to the impingement of the electron beam 5 and by deformation of the shadow mask by thermal expansion of the mask frame 9 occurred as the heat generated by the impingement of the electron beam 5 is transferred to the mask frame 9. Such doming effect will be described with reference to FIGS. 3A, 3B and 4.

FIG. 3A is a schematic view showing a doming effect of a shadow mask of the conventional cathode ray tube, FIG. 3B is a schematic view showing a doming effect of a shadow mask caused by thermal expansion of a mask frame of the conventional cathode ray tube, and FIG. 4 is graph roughly showing a doming effect in FIGS. 3A and 3B.

That is, as shown in FIG. 3A, at a moment that a power is applied to the cathode ray tube, part of the electron beam impinges on the shadow mask 8 and the shadow mask 8 is heated and expanded by heat at temperature of 80~100° C. generated by the above impingement.

Therefore, the electron beam through hole 15 of the shadow mask 8 is displaced as a predetermined distance, and the landing position of the electron beam 5 is displaced as ΔA.

In this case, a miss-landing that the electron beam can not landed on an appropriate fluorescent surface 13 is occurred, and by the miss-landing of the electron beam 5*a*, color purity of the screen is degraded.

On the other hand, heat generated in the shadow mask 5*a* is gradually transferred to the mask frame 9, and heat transferred to the mask frame 9 expands the mask frame 9. Therefore, the expanding mask frame 9*b* pulls the heated and expanded shadow mask 8*a*.

That is, as shown in FIG. 3B, the surface of the shadow mask 8*b* is deformed by expansion of the mask frame 9*b* and the position of the electron beam through hole 15 is displaced.

Therefore, the landing position of the electron beam 5 is displaced as ΔB by displacement of the electron beam through hole 15, and accordingly, miss-landing that the electron beam 5*b* can not land on an appropriate fluorescent surface 13 is occurred, thus to degrade color purity of the screen by miss-landing of the electron beam 5*b*.

On the other hand, as shown in FIG. 4, a miss-landing amount ΔB generated by the doming effect of the shadow mask 8 caused by thermal expansion of the mask frame 9 is larger than the miss-landing amount ΔA which is generated by the doming effect caused by thermal expansion of the shadow mask 8, and the miss-landing directions are different.

Also, the miss-landing phenomenon (A) by thermal expansion of the mask frame 9 is generated for a longer time than that of the miss-landing phenomenon (B) caused by thermal expansion of the shadow mask, and the miss-landing phenomenon (A) affects more on quality degradation of the cathode ray tube.

That is, doming effect of the shadow mask 8 caused by thermal expansion of the mask frame 9 affects more on degradation of performance of matching landing of the electron beam in manufacturing the cathode ray tube and color purity of the screen than the initial doming effect which is generated by thermal expansion of the shadow mask 8.

The doming effect of the shadow mask caused by thermal expansion of the mask frame 9 is generated as the heated and expanded mask frame 9 pulls the skirt portion 21 of the shadow mask 8. As shown in FIG. 5, a portion where a force that the mask frame 9 pulls the shadow mask 8 is adjacent from the welding spot (portion indicated with oblique lines) of the mask frame 9 and shadow mask 8, and the direction of the force that the mask frame 9 pulls the shadow mask 8 is same as the direction of an arrow shown in FIG. 5.

On the other hand, to reduce the doming effect, the supporting spring 11 which is positioned between the mask frame 9 and the panel 3 for reducing thermal expansion of the mask frame 9 can be composed of two materials having different thermal expansion coefficients, but in case such supporting spring composed of different materials is used, cost of materials was increased.

SUMMARY OF THE INVENTION

Therefore, an object of the present invention is to provide a shadow mask of a cathode ray tube capable of reducing doming effect of the shadow mask by adjusting the shape of a guiding notch in which a guiding pin for matching the standard of the shadow mask in press molding of the shadow mask, and improving performance in press molding of the shadow mask.

To achieve these and other advantages and in accordance with the purpose of the present invention, as embodied and broadly described herein, there is provided a cathode ray tube including a shadow mask which is composed of a effective portion having a plurality of holes through which an electron beam passes and a skirt portion extended approximately in a perpendicular direction to the effective portion, wherein a guiding notch is formed in the skirt portion, the guiding notch includes an end portion which is formed to be opened to the end of the skirt portion and a fixing portion to which a guiding means is fixed, and a width of the end portion is wider than the diameter of the fixing portion.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

As described above, doming effect is generated in the cathode ray tube by thermal expansion of a shadow mask and a mask frame.

Here, the doming effect by thermal expansion of the shadow mask is proceeded in about two minutes after turning on the power of the cathode ray tube, and it affects less on degradation of quality of the cathode ray tube.

However, the doming effect of the shadow mask caused by thermal expansion of the mask frame has a larger scope than the doming effect caused by thermal expansion of the shadow mask, and since it is proceeded for a long time as 2 to 25 minutes after turning of the power of the cathode ray tube, it affects much on performance of matching landing in manufacturing the cathode ray tube and color purity of the screen.

The doming effect of the shadow mask caused by thermal expansion of the mask frame is generated as the heated and expanded mask frame pulls a skirt portion of the shadow mask and a portion where a pulling force is acted is adjacent to the welding spot Here, when the mask frame is heated and expanded under the condition that the size of the guiding notch which is positioned in a position where the welding spot of the shadow mask is positioned, influence of the mask frame on the skirt portion of the shadow mask is spread into a whole region around the guiding notch.

In this case, the mask frame also affects on the curved surface of the shadow mask and accordingly a phenomenon that the curvature is sunk (that is, a phenomenon that the height of the curvature of the shadow mask is sunk) is occurred.

Therefore, by extending the vertical length of the guiding notch portion, influence generated in a portion that the shadow mask and mask frame are fixed is induced not to be transferred to the upper side of the skirt portion, thus to reduce the doming effect of the shadow mask caused by thermal expansion of the mask frame.

Figure 1:
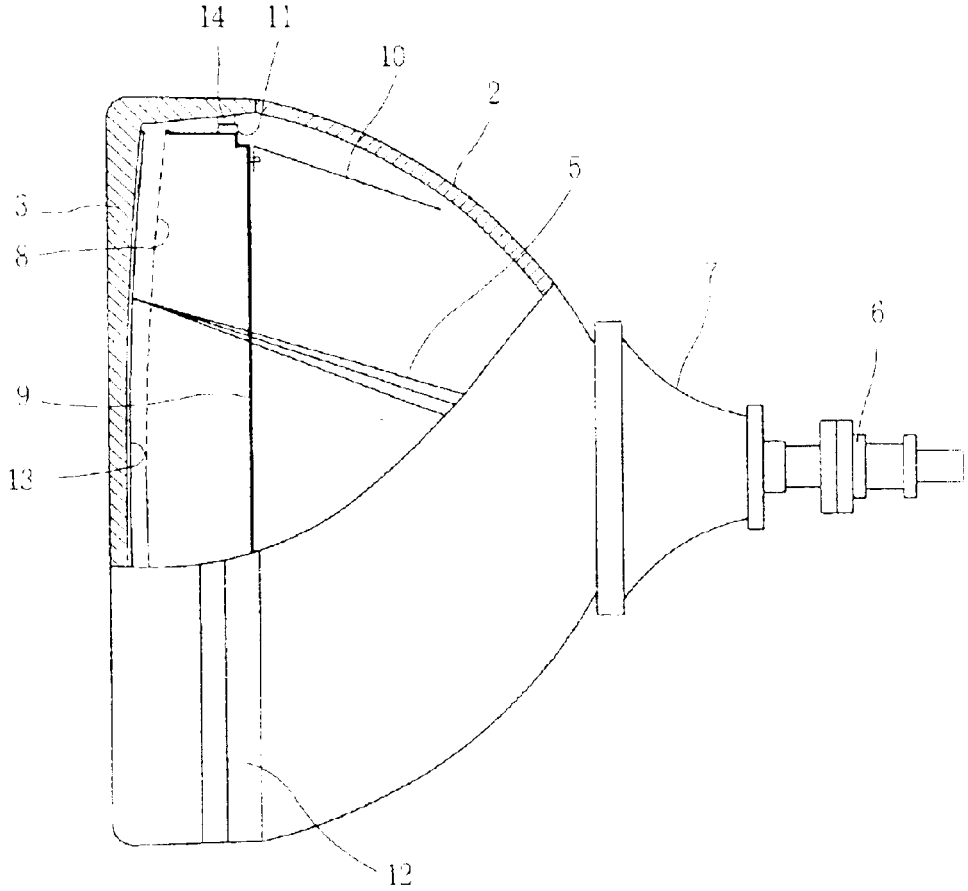
FIG. 1 CONVENTIONAL ART
FIG. 1 is a schematic view showing an example of a cathode ray tube.
Figure 2:
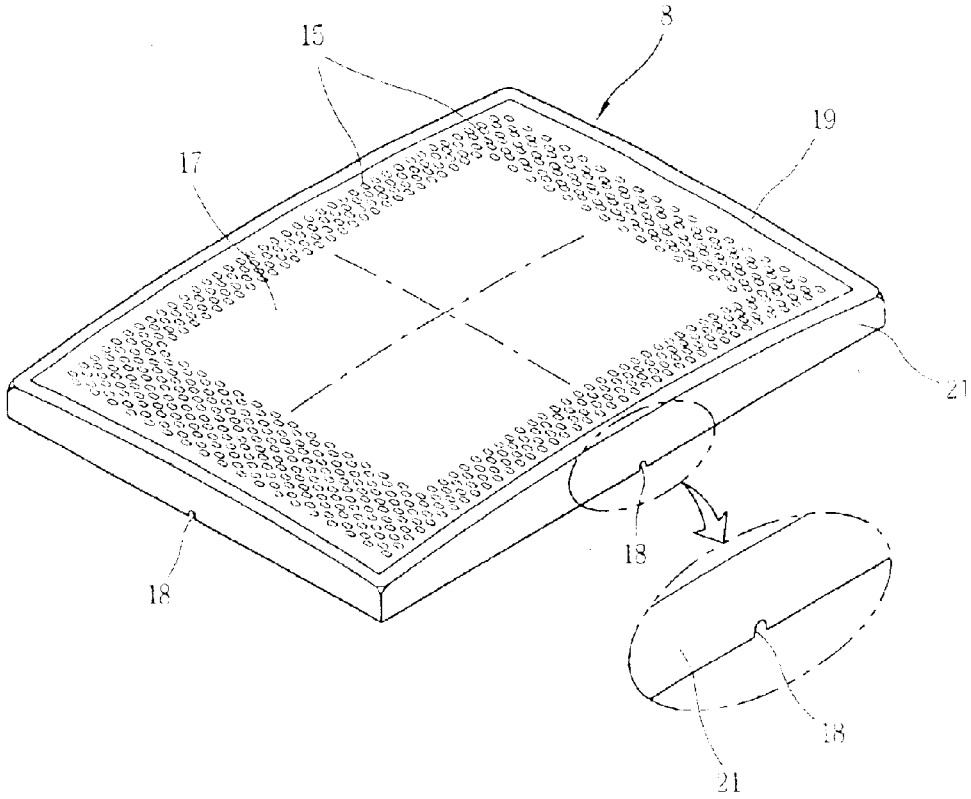
FIG. 2 CONVENTIONAL ART
FIG. 2 is a perspective view showing a shadow mask of a conventional cathode ray tube.
Figure 3A:
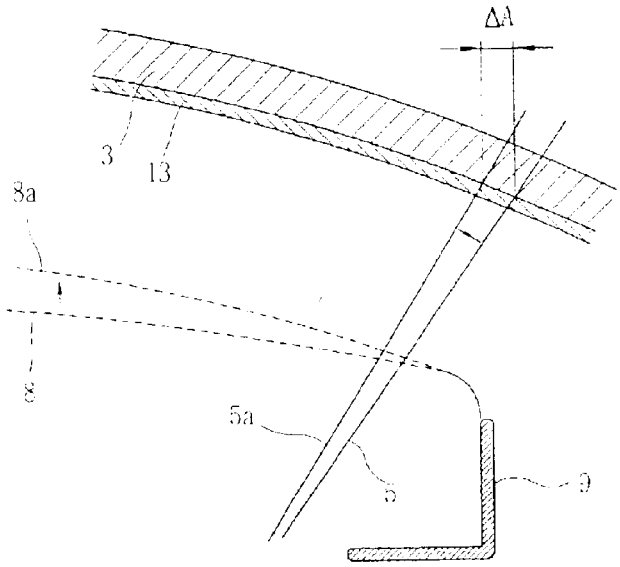
FIG. 3A CONVENTIONAL ART
FIG. 3A is a view showing a doming effect of a shadow mask caused by thermal expansion of the shadow mask of the conventional cathode ray tube.
Figure 3B:
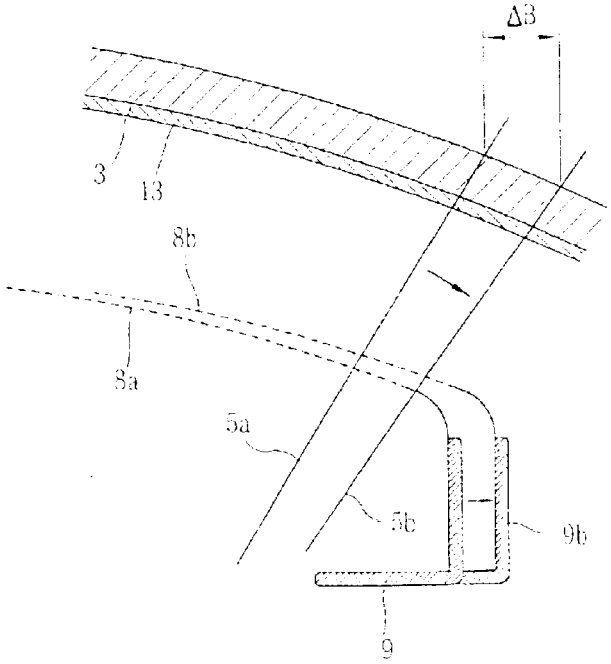
FIG. 3B CONVENTIONAL ART
FIG. 3B is a view showing a doming effect of a mask frame caused by thermal expansion of a mask frame of the conventional cathode ray tube.
Figure 4:
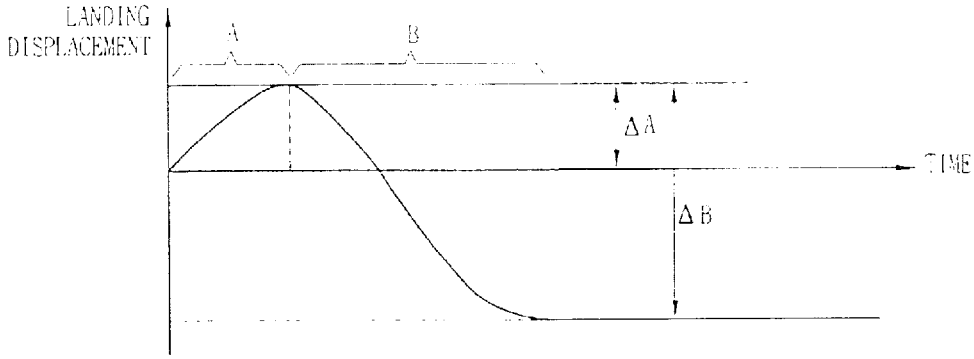
FIG. 4 CONVENTIONAL ART
FIG. 4 is a graph roughly showing a doming effect of the shadow mask of the conventional cathode ray tube.
Figure 5:
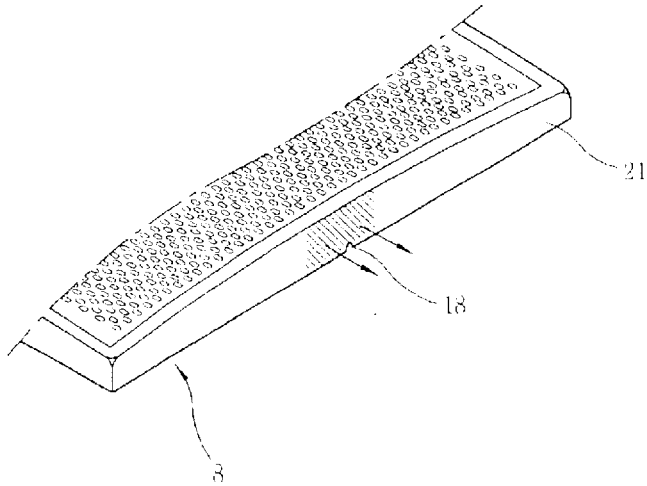
FIG. 5 CONVENTIONAL ART
FIG. 5 is a partial perspective view of the shadow mask showing a portion which affects on the shadow mask in heat expanding of the mask frame of the conventional cathode ray tube.
Figure 6:
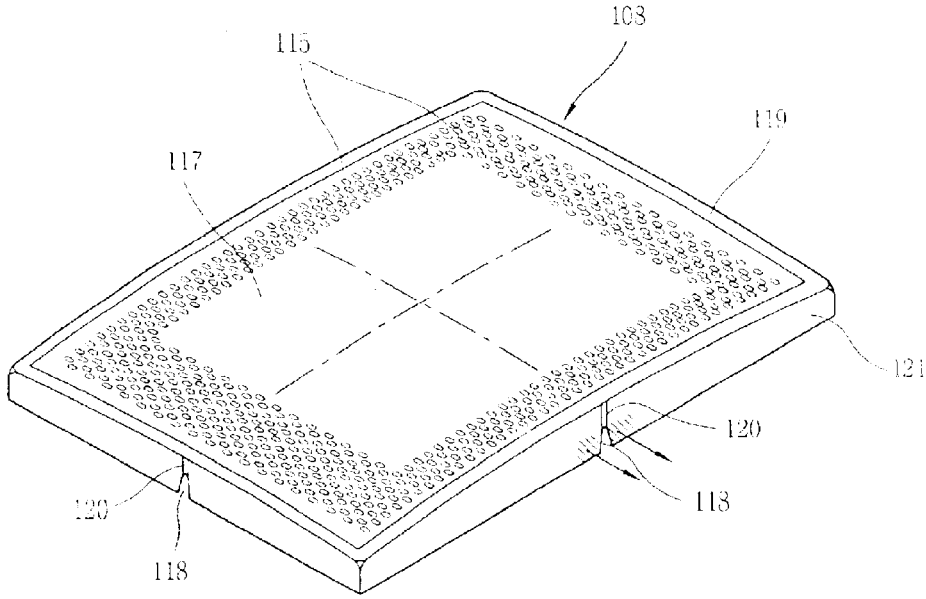
FIG. 6 is a perspective view showing a shadow mask of a cathode ray tube in accordance with the present invention.

As shown in FIG. 6, the shadow mask 108 of the cathode ray tube in accordance with the present invention is a device for sorting colors so that an electron beam can selectively land on a fluorescent surface, and it includes a effective portion 117 having a plurality of electron beam through holes 115 at the center, a ineffective portion 119 which is formed at the circumference of the effective portion 117 without having the electron beam through hole 115, and a skirt portion 121 which is formed at the circumference of the ineffective portion 119 and is fixed on the mask frame.

On one surface of the skirt portion 121 of the shadow mask 108, a guiding notch 118 in which a guiding pin (not shown) of a press device for deciding the standard position of the shadow mask 108 and preventing deflection and rotation of the shadow mask 108 in press molding is formed.

Here, the guiding pin is different according to models of the shadow mask 108 and manufacturers, but generally, guiding pins having a diameter of 1.5~3.0 mm are used.

Figure 7A:
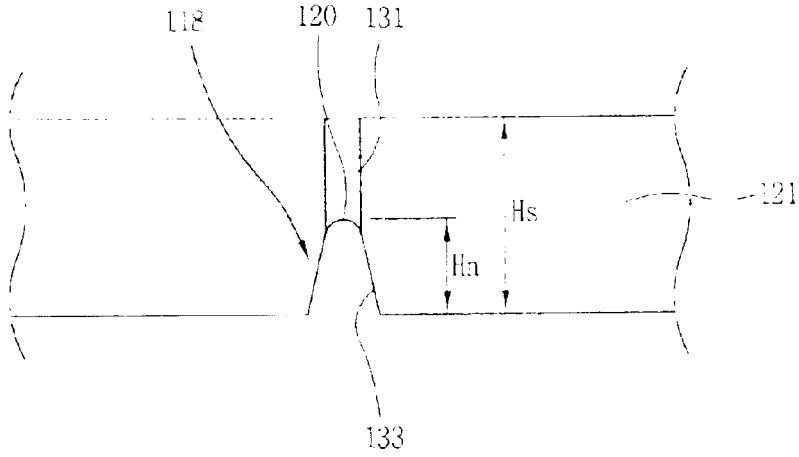
FIG. 7A is a front view showing a guiding notch of the shadow mask of the cathode ray tube in accordance with the present invention.
Figure 7B:
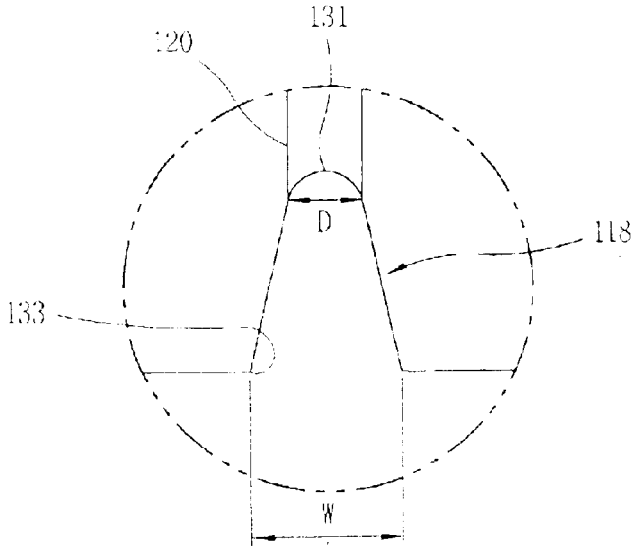
FIG. 7B is a front view enlarging the guiding notch of the shadow mask in FIG. 7A.

As shown in FIGS. 7A and 7B, the guiding notch 118 includes an end portion 133 formed to be opened to the end of the skirt portion 121 of the shadow mask 108, and a semicircular fixing portion 131 in which the guiding pin is fixed while being formed in a position of a predetermined height from the end portion 133.

The fixing portion 131 of the guiding notch 118 is formed to match the diameters of the guiding pins, and the guiding notch 118 is formed at a center of the long side or short side of the skirt portion 121, and the guiding notch 118 is selectively formed at one or more sides among four sides of the skirt portion 121 of the shadow mask 108.

Also, a bead 120 having a predetermined width and depth is formed between the fixing portion 131 of the guiding notch 118 and the boundary of the ineffective portion 119 of the shadow mask 108 and the skirt portion 121 to raise strength of the skirt portion.

The guiding notch 118 of the shadow mask 108 of the cathode ray tube in accordance with the present invention has a higher vertical height than the conventional guiding notch 18, thus to prevent influence generated in a portion where the shadow mask and mask frame are fixed from being spread in an upward direction from the skirt portion. Therefore, the doming effect of the shadow mask caused by thermal expansion of the mask frame can be reduced.

The doming effect according to the guiding notch 118 in accordance with the present invention and the conventional guiding notch 18 will be described with reference to Table 1 and FIG. 8.

TABLE 1

| Guiding Notch | | Landing Displacement | | |
|---|---|---|---|---|
| Type | Height, Hn (mm) | ΔA (μm) | ΔB − ΔA (μm) | ΔB (μm) |
| Conventional Art | 2 | 5 | 12 | 17 |

TABLE 1-continued

| Guiding Notch | | Landing Displacement | | |
|---|---|---|---|---|
| Type | Height, Hn (mm) | ΔA (μm) | ΔB − ΔA (μm) | ΔB (μm) |
| Present Invention | 6 | 5 | 7 | 12 |

Figure 8:
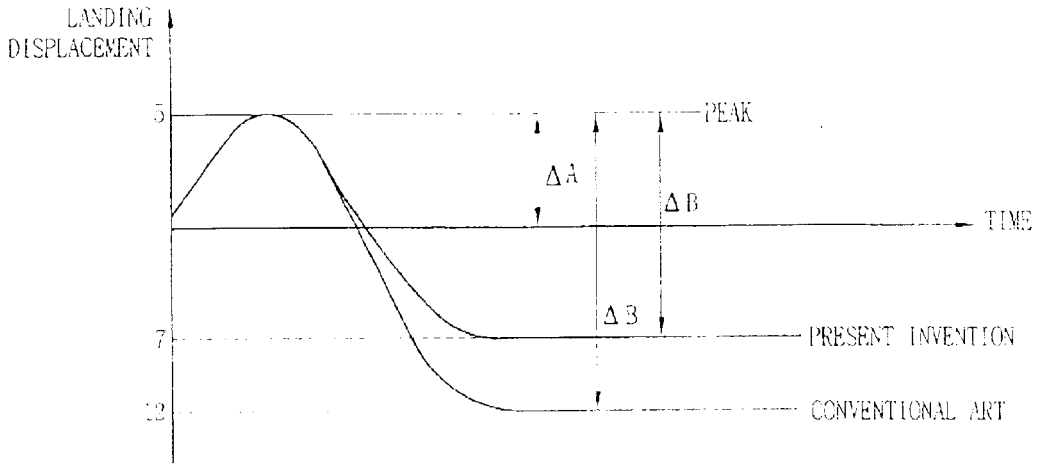
FIG. 8 is a graph which compares the doming effect of cathode ray tubes in accordance with the conventional art and present invention.

As shown in Table 1 and FIG. 8, a mis-landing amount ΔB of the conventional shadow mask with a height of the guiding notch Hn as 2 mm was 17 μm, and on the other hand, the miss-landing amount ΔB of the shadow mask of the present invention with a height of the guiding notch 118 Hn as 6 mm was 18 μm.

Accordingly, there was a decrease of 5 μm in the miss-landing amount.

That is, as a result of raising the height Hn of the guiding notch 118 from 2 mm to 6 mm, the doming effect of the shadow mask caused by thermal expansion of the mask frame was reduced.

On the other hand, the height Hn of the guiding notch 118 must be formed as 30% or more of the total height Hs from the end of the skirt portion 121 by taking the position of the welding spot in the mask frame under the consideration.

Also, in case of press molding of the shadow mask 108, since a compressed spot that the press is compressed on the shadow mask 108 is positioned in the upper side of the skirt portion of the shadow mask 108, when the press compresses the shadow mask 108, the height Hn of the guiding notch 118 is appropriate to be 60% or lower than 60% of the height Hs of the skirt portion 121 to prevent unevenness of the pressure.

That is, the height Hn of the guiding notch 118 must satisfy the following condition for the total height Hs of the skirt portion 121 of the shadow mask 108.

$$0.3 \leqq Hn/Hs \leqq 0.6 \quad (1)$$

On the other hand, in case a vertical height Hn of the guiding notch 118 is formed so that a diameter D of the fixing portion 131 of the guiding notch 118 is same as a width W of the end portion 133, the shadow mask 108 can not exactly positioned in the press mold as the guiding pin can not be easily inserted in the guiding notch 118. Also, an imprint can be generated in the skirt portion 121 by the guiding pin, thus to cause deformation of the surface of the shadow mask 108.

Therefore, the guiding notch 118 forms the width W of the end portion 133 to be larger than the diameter D of the fixing portion 131, and it is desirable that the width becomes smaller along from the end portion of the guiding notch 118 to the fixing portion 131, that is, in a taper shape.

That is, the guiding notch 118 has a trapezoid shape, of which the width is gradually increased towards the end portion 133 from the fixing portion 131.

Therefore, in case the guiding notch 118 is formed in a tapered trapezoid shape, when the guiding pin is inserted in the guiding notch 118, the guiding pin is slid on the tapered portion of the guiding notch and insertion can be smoothly performed to the fixing portion 131.

At this time, as a result of the actual test, to perform insertion of the guiding pin more smoothly, the width W of the end portion 133 of the guiding notch 118 was preferably formed about 40~70% larger than the diameter of the fixing portion D of the guiding notch 118.

That is, the width W of the end portion 133 of the guiding notch 118 and the diameter D of the fixing portion 131 of the guiding notch 118 are formed to satisfy the following formula (2).

$$1.4 \leqq W/D \leqq 1.7 \quad (2)$$

Meanwhile, as aforementioned, since the diameter of the guiding pin is formed to be 1.5~3.0 mm, the diameter D of the fixing portion 131 is formed to be equal to the diameter of the guiding pin as the following formula (3).

$$1.5\ \text{mm} \leqq D \leqq 3.0\ \text{mm} \quad (3)$$

Therefore, from the formulas (2) and (3), the width W of the end portion 133 of the guiding notch 118 is formed to be 2.1~7.1 mm.

$$2.1\ \text{mm} \leqq W \leqq 7.1\ \text{mm} \quad (4)$$

The shadow mask of the cathode ray tube in accordance with the present invention forms the diameter of the fixing portion 131 of the guiding notch 118 identically as the diameter of the guiding pin of the press mold and has the width W of the end portion 133 larger than the diameter D of the fixing portion 131, thus to improve the performance in press molding of the shadow mask.

The shadow mask of the cathode ray tube in accordance with the present invention with the above construction can reduce the doming effect of the shadow mask and improve the performance in press processing of the shadow mask by setting the vertical height of the guiding notch as 30~60% of the total height of the skirt portion, forming the width of the end portion which is opened to the skirt portion of the guiding notch larger than the width of the fixing portion that the guiding notch is fixed and reducing influence of the thermal expansion of the mask frame on the shadow mask.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A cathode ray tube including a shadow mask which comprises a effective portion having a plurality of holes through which an electron beam passes and a skirt portion extended approximately in a perpendicular direction to the effective portion, wherein a guiding notch receiving a guiding pin for deciding a standard position of the shadow mask is formed in the skirt portion, the guiding notch includes an end portion which is formed to be opened to the end of the skirt portion and a fixing portion to which said guiding pin is fixed, and a width of the end portion is wider than the diameter of the fixing pin.

2. The cathode ray tube of claim 1, wherein in case a height of the guiding notch is Hn and a height of the skirt portion is Hs, the following formula is satisfied:

$$0.3 \leqq Hn/Hs \leqq 0.6.$$

3. The cathode ray tube of claim 1, wherein in case a width of an end portion of the guiding notch is W and the diameter of the fixing portion of the guiding notch is D, the following formula is satisfied:

$$1.4 \leqq W/D \leqq 1.7.$$

4. The cathode ray tube of claim 3, wherein in case a diameter of the fixing portion is D, the following formula is satisfied:

$$1.5\ \text{mm} \leqq D \leqq 3.0\ \text{mm}.$$

5. The cathode ray tube of claim 3, wherein in case the width of the end portion of the guiding notch is W, the following formula is satisfied:

$$2.1\ \text{mm} \leqq W \leqq 7.1\ \text{mm}.$$

6. The cathode ray tube of claim 1, wherein a bead is formed between the boundary of the effective portion and the skirt portion and the fixing portion of the guiding notch.

7. The cathode ray tube of claim 1, wherein the width of the guiding notch gradually increases along from the fixing portion to the end portion of the guiding notch.

8. The cathode ray tube of claim 7, wherein the guiding notch is formed in a trapezoid shape.

9. The cathode ray tube of claim 1, wherein the guiding pin has a diameter of 1.5–3.0 mm.

10. A cathode ray tube including a shadow mask which comprises a effective portion having a plurality of holes through which an electron beam passes and a skirt portion which is extended approximately perpendicularly to the effective portion, wherein a guiding notch in which a position setting means for aligning of the shadow mask in press molding is approximately formed in a trapezoid shape in the skirt portion of the shadow mask, and a width of a end portion which is opened to the end of the skirt portion is formed 40~70% larger than the diameter of a fixing portion to which the position setting means is fixed.

11. The cathode ray tube of claim 10, wherein in case a height of the guiding notch is Hn and a height of the skirt portion is Hs, the following formula is satisfied:

$$0.3 \leqq Hn/Hs \leqq 0.6.$$

12. The cathode ray tube of claim 10, wherein the guiding notch is formed at the center of the long side or short side of the skirt portion of the shadow mask.

13. The cathode ray tube of claim 10, wherein the guiding notch is installed at three sides among four sides of the skirt portion of the shadow mask.

14. A cathode ray tube including a shadow mask which comprises a effective portion having a plurality of holes through which an electron beam passes and a skirt portion extended approximately in a perpendicular direction to the effective portion, wherein a guiding notch is formed in the skirt portion, the guiding notch includes an end portion which is formed to be opened to the end of the skirt portion and a fixing portion to which a guiding means is fixed, and a width of the end portion is wider than the diameter of the fixing portion, and in case a height of the guiding notch is Hn and a height of the skirt portion is Hs, the following formula is satisfied:

$$0.3 \leqq Hn/Hs\ 0.6.$$

15. A cathode ray tube including a shadow mask which comprises a effective portion having a plurality of holes through which an electron beam passes and a skirt portion extended approximately in a perpendicular direction to the effective portion, wherein a guiding notch is formed in the skirt portion, the guiding notch includes an end portion which is formed to be opened to the end of the skirt portion and a fixing portion to which a guiding means is fixed, and a width of the end portion is wider than the diameter of the fixing portion, and in case a width of an end portion of the guiding notch is W and the diameter of the fixing portion of the guiding notch is D, the following formula is satisfied:

$$1.4 \leqq W/D \leqq 1.7.$$

16. The cathode ray tube of claim 15, wherein in case a diameter of the fixing portion is D, the following formula is satisfied:

$$1.5\ \text{mm} \leqq D \leqq 3.0\ \text{mm}.$$

17. The cathode ray tube of claim 15, wherein in case the width of the end portion of the guiding notch is W, the following formula is satisfied:

$$2.1\ \text{mm} \leqq W \leqq 7.1\ \text{mm}.$$

18. A cathode ray tube including a shadow mask which comprises a effective portion having a plurality of holes through which an electron beam passes and a skirt portion extended approximately in a perpendicular direction to the effective portion, wherein a guiding notch is formed in the skirt portion, the guiding notch includes an end portion which is formed to be opened to the end of the skirt portion and a fixing portion to which a guiding means is fixed, and a width of the end portion is wider than the diameter of the fixing portion, and a bead is formed between the boundary of the effective portion and the skirt portion and the fixing portion of the guiding notch.

* * * * *